US006918452B2

(12) United States Patent
Chan et al.

(10) Patent No.: US 6,918,452 B2
(45) Date of Patent: Jul. 19, 2005

(54) DRILL STRING SHUTOFF VALVE

(75) Inventors: Kwong-Onn C. Chan, Edmonton (CA); Behrooz Movaffagh, Edmonton (CA); Loren Boisvert, Edmonton (CA)

(73) Assignee: Vetco Gray Inc., Houston, TX (US)

( * ) Notice: Subject to any disclaimer, the term of this patent is extended or adjusted under 35 U.S.C. 154(b) by 131 days.

(21) Appl. No.: 10/321,087

(22) Filed: Dec. 17, 2002

(65) Prior Publication Data

US 2004/0112641 A1 Jun. 17, 2004

(51) Int. Cl.[7] ..... E21B 17/18

(52) U.S. Cl. ..... 175/21; 175/318; 175/324; 166/334.1

(58) Field of Search ..... 175/19, 21, 38, 175/296, 317, 318, 324, 417; 166/331, 332.2, 334.1, 386

(56) References Cited

U.S. PATENT DOCUMENTS

| | | | | |
|---|---|---|---|---|
| 4,015,673 A | | 4/1977 | Craig, Jr. et al. | |
| 4,321,974 A | | 3/1982 | Klemm | |
| 4,509,606 A | | 4/1985 | Willis | |
| 4,596,294 A | * | 6/1986 | Russell | 175/74 |
| 4,705,119 A | | 11/1987 | Kostylev et al. | |
| 4,709,768 A | | 12/1987 | Kostylev et al. | |
| 4,790,391 A | | 12/1988 | Hamamura et al. | |
| 4,848,486 A | | 7/1989 | Bodine | |
| 4,854,397 A | | 8/1989 | Warren et al. | |
| 5,042,597 A | | 8/1991 | Rehm et al. | |
| 5,148,875 A | | 9/1992 | Karlsson et al. | |
| 5,165,491 A | | 11/1992 | Wilson | |
| 5,407,021 A | | 4/1995 | Kane et al. | |
| 5,435,400 A | | 7/1995 | Smith | |
| 5,538,091 A | | 7/1996 | Theocharopoulos | |
| 5,615,739 A | | 4/1997 | Dallas | |
| 5,957,226 A | | 9/1999 | Holte | |
| 6,047,784 A | | 4/2000 | Dorel | |
| 6,209,660 B1 | | 4/2001 | Cox | |
| 6,209,665 B1 | | 4/2001 | Holte | |

* cited by examiner

*Primary Examiner*—Zakiya Walker
(74) *Attorney, Agent, or Firm*—Bracewell & Giuliani LLP

(57) ABSTRACT

A valve assembly connects into a drill string for opening and closing the inner passage within the drill string. The valve member moves between the open and closed positions in response to axial movement of the drill string. The valve member has an upper portion and a lower portion. A valve member and valve sleeve are located within an inner passage. Lifting the drill string causes the upper portion to move upward relative to the lower portion, bringing along with it the valve member, while the valve sleeve remains stationary with the lower portion, opening the valve.

20 Claims, 3 Drawing Sheets

DRILL STRING SHUTOFF VALVE

FIELD OF THE INVENTION

This invention relates in general to safety shutoff valves, and particularly to a safety shutoff valve located in a drill string for drilling a well.

BACKGROUND OF THE INVENTION

Most oil and gas wells are drilled with a rotary drilling rig. Typically, the drill string has a drill bit on the end and is rotated to cause the drill bit to advance into the earth. A drilling fluid is pumped down the interior passage of the drill pipe, which exits nozzles on the drill bit and flows back up an annular space surrounding the drill pipe along with cuttings.

Normally, the drilling fluid is a liquid called mud, which has a weight selected to provide a hydrostatic pressure greater than the expected earth formation pressures. When tripping the drill string in and out of the hole, the drilling mud in the hole and within the interior of the drill pipe provide sufficient hydrostatic pressure to prevent a blowout. However, heavy drilling mud can damage certain earth formations, reducing their abilities to produce fluids after completion. For example, methane is located in certain fairly deep coal beds. The coal formations may be damaged by encroaching drilling mud.

Drilling with gaseous fluids, such as air, has also been done with oil and gas wells. In one techniques, compressed air flows down the interior of the drill pipe, exits the drill bit and flows back up the annulus. A stripper seal surrounds the drill pipe at the surface for sealing the gas pressure in the well. Also, compressed air is used as a drilling fluid for drilling shallow mining blast holes. Mining drilling rigs may employ a dual passage string of drill pipe, with one of the passages being an inner passage and the other an annular passage. A gaseous fluid such as air is pumped down the annular passage and flows back up the inner passage along with cuttings. The dual passage drill pipe can be rotated to rotate the drill bit. Alternately, a downhole motor can be utilized which may also create a reciprocating a hammer motion as well as rotating the drill bit while the drill pipe remains stationary.

The possibility of a blowout due to excessive earth formation pressure is not a factor with shallow drilling of mining blast holes. With deep oil and gas drilling, however, it must be considered both while drilling and while tripping the drill pipe in and out of the hole. Blowout preventers and rams are utilized to seal around the annulus of drill pipe. The use of check valves in the drill string has been proposed in the past. The primary barrier to a blowout, however, continues to be the use of drilling mud with sufficient weight to provide a higher hydrostatic pressure than any expected pressure of the earth formations.

SUMMARY OF THE INVENTION

In this invention, a valve assembly is mounted in a string of drill pipe for selectively closing the inner passage of the drill pipe. The valve is closed by selective movement of the drill pipe from the surface. Preferably, the valve may be closed by placing the drill string in tension. This may occur while running into the well and also by lifting the drill bit from the bottom of the well. Also, preferably a retainer mechanism is employed with the valve for retaining the valve in either the open position or the closed position. The retainer mechanism is actuated in the preferred embodiment by rotating the drill string a selected increment.

The valve assembly of the preferred embodiment is particularly for use with a drill string for drilling with a gaseous drilling fluid. The drill string is preferably of a dual passage type, having an inner conduit and an annular passage surrounding the inner conduit. Compressed gas flows down the annular passage, and returns up the inner passage along with cuttings.

In the preferred embodiment, the valve assembly has an outer member and an inner member, defining an inner passage and an annular passage for the fluid flow. The inner and outer members have upper and lower portions that are axially movable relative to each other. A valve is mounted in the inner member. The valve has one portion that moves with the upper portion of the inner and outer members. The other part of the valve remains stationary with the lower portions of the inner and outer members. Lifting the upper portion mechanically or hydraulically causes the two cooperative portions of the valve to move relative to each other, causing the valve to move to a closed position.

DETAILED DESCRIPTION OF THE INVENTION

Figure 1A:
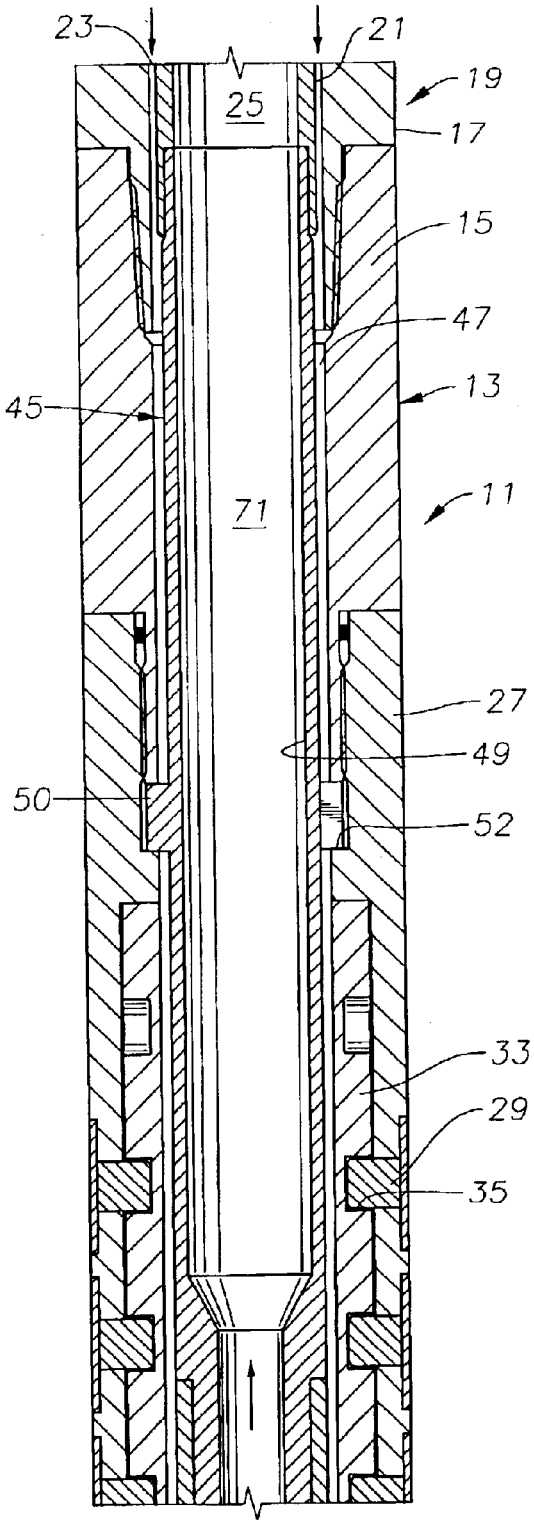
FIGS. 1A and 1B comprise a vertical sectional view of a valve assembly constructed in accordance with this invention and shown in an open position.

Referring to FIG. 1, valve assembly 11 includes an outer tubular member 13, which is made up of several components. An upper adapter 15 forms the upper end of outer member 13. Upper adapter 15 is a tubular member having threads on its upper end for connection to an outer conduit 17 of a dual passage drill string 19. Drill string 19 preferably has an inner conduit 21 extending through it. An annular passage 23 surrounds inner conduit 21, and an inner passage 25 extends through inner conduit 21. Inner conduit 21 and outer conduit 17 may be made of continuous coiled tubing, which is typically of metal. Alternately, outer conduit 17 may be made up of segments of pipe secured together, and inner conduit 21 could be formed of sections of pipe that stab together.

Outer member 13 also has an upper sub 27 that secures to the lower end of adapter 15. Upper sub 27 is a tubular member that has a plurality of pins 29 secured to it. Preferably there are two sets of pins 29, each pin 29 in each set being axially aligned with the others in the same set. The sets of pins 29 are spaced 180° apart and extend radially inward. Upper sub 27 also has a plurality of spaced apart downward facing lugs 31 on its lower end. Lugs 31 contact an upper shoulder of a lower sub 33 of outer member 13 when valve assembly 11 is in the retracted position shown in FIGS. 1A and 1B.

Figure 3:
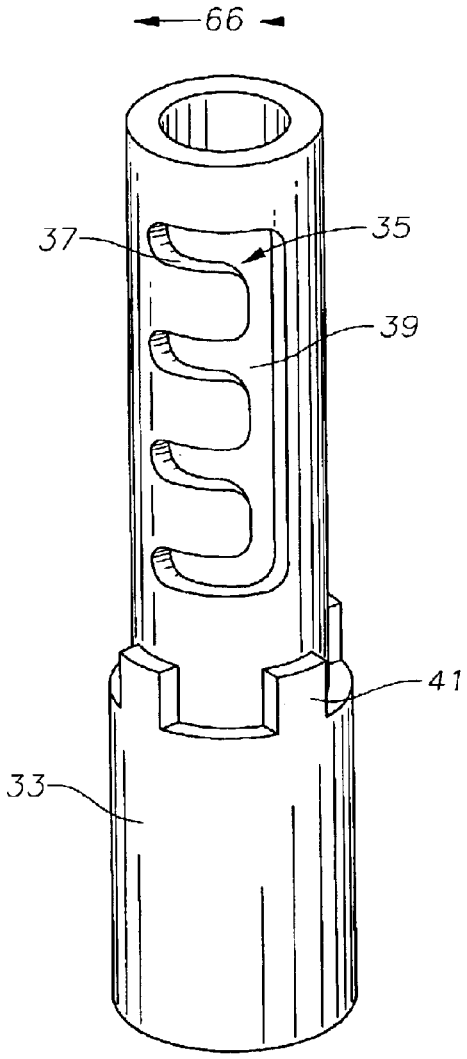
FIG. 3 is a perspective view of part of a lower sub of the outer member of the valve assembly of FIGS. 1A and 1B.
Figure 4:
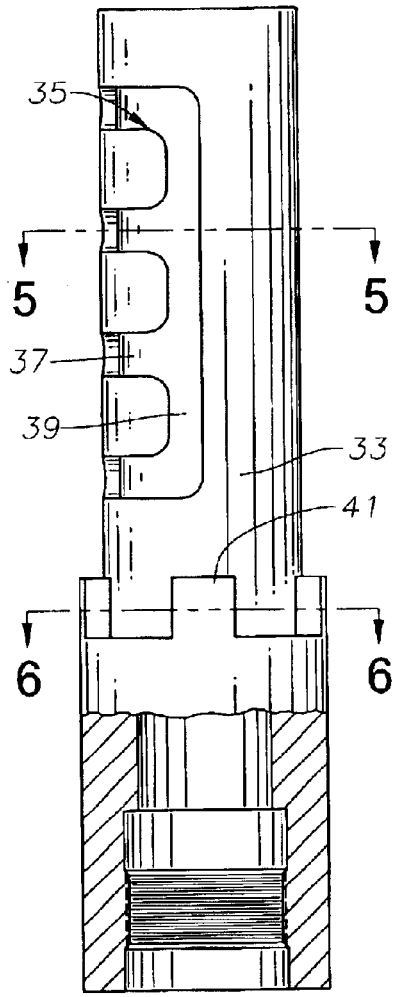
FIG. 4 is a side elevational view, partially sectioned, of the lower sub of FIG. 3.
Figure 5:
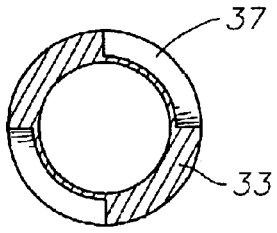
FIG. 5 is a sectional view of the lower sub of FIG. 3, taken along the line 5—5 of FIG. 4.
Figure 6:
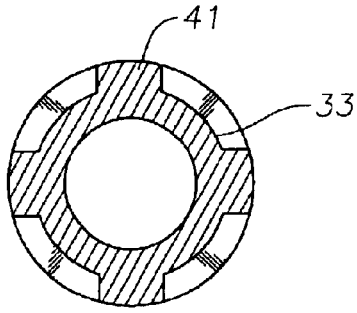
FIG. 6 is a sectional view of the lower sub of FIG. 3, taken along the line of 6—6 of FIG. 4.

Lower sub 33 is a tubular member that has an upper reduced diameter portion that inserts into upper sub 27 and contains a pair of slots 35 for engagement by pins 29. Slots 35 are spaced 180° from each other in this embodiment. As shown in FIG. 3, each slot 35 has a plurality of transverse portions 37 that extend circumferentially about 90° and are parallel to each other. Each transverse portion 37 is perpendicular to the longitudinal axis of lower sub 33 and leads to an axial portion 39 that extends along the length of lower sub 33. Each slot 35 does not extend entirely through the sidewall of lower sub 33, thus does not communicate with the interior of the lower sub 33. Lower sub 33 also has a plurality upward facing lugs 41 that have spaces between them for receiving downward facing lugs 31 (FIG. 1B) of upper sub 27.

Figure 1B:
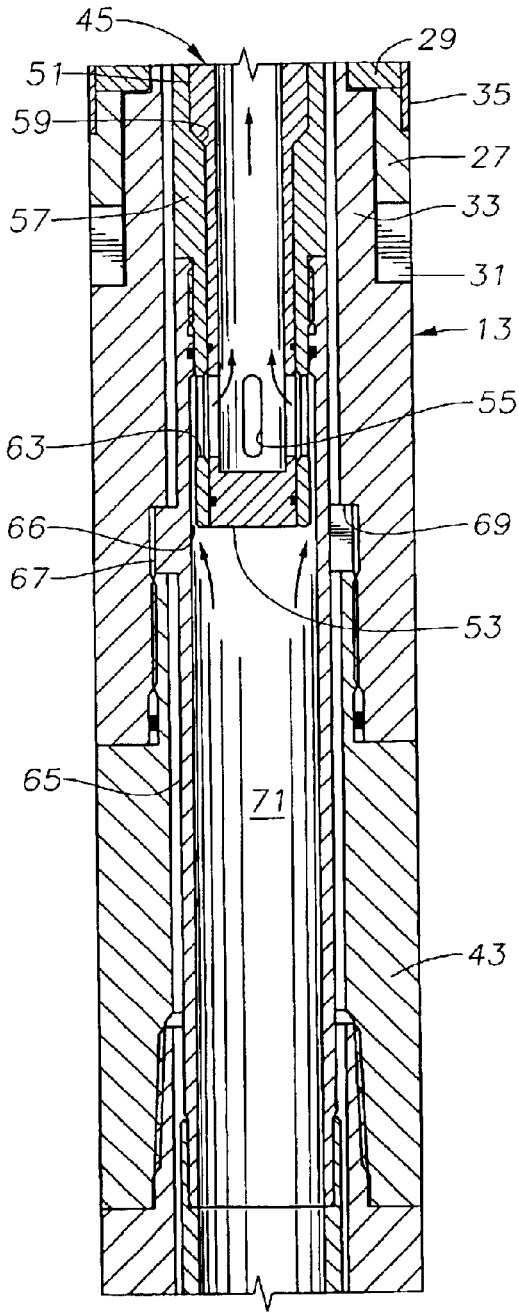

There are more transverse portions 37 of each slot 35 than pins 29. Each set has three pins 29 in this example, while there are four transverse portions 37 (FIG. 3) in each slot 35. Pins 29 are located in the lower three transverse slots 37 while valve assembly 11 is in the open and retracted position of FIGS. 1A and 1B. While in this position, lugs 31 and 41 are intermeshed with each other as shown in FIG. 1B. Each space between each upward extending lug 41 is wider than each downward extending lug 31. This allows upper sub 27 to rotate counterclockwise (looking downward) an increment relative to lower sub 33 while lugs 41 and 31 are intermeshed. While doing so, pins 29 will move from the transverse portions 37 to the axial portion 39. Then, upper sub 27 can move upward relative to lower sub 33 a short distance until the uppermost pin 29 of each set (FIG. 1B) contacts the upper end of axial portion 39. At this point, upper sub 27 can be rotated an increment clockwise relative to lower sub 33 to cause the three pins 29 to enter the upper three transverse portions 37.

The total number of transverse portions 37 should exceed the total number of pins 29, however the number could differ from the four transverse portions 37 and three pins 29 shown in the preferred embodiment. Although lugs 31, 41 allow limited rotation of upper sub 27 relative to lower sub 33, they will transmit torque once in engagement with each other.

Figure 2A:
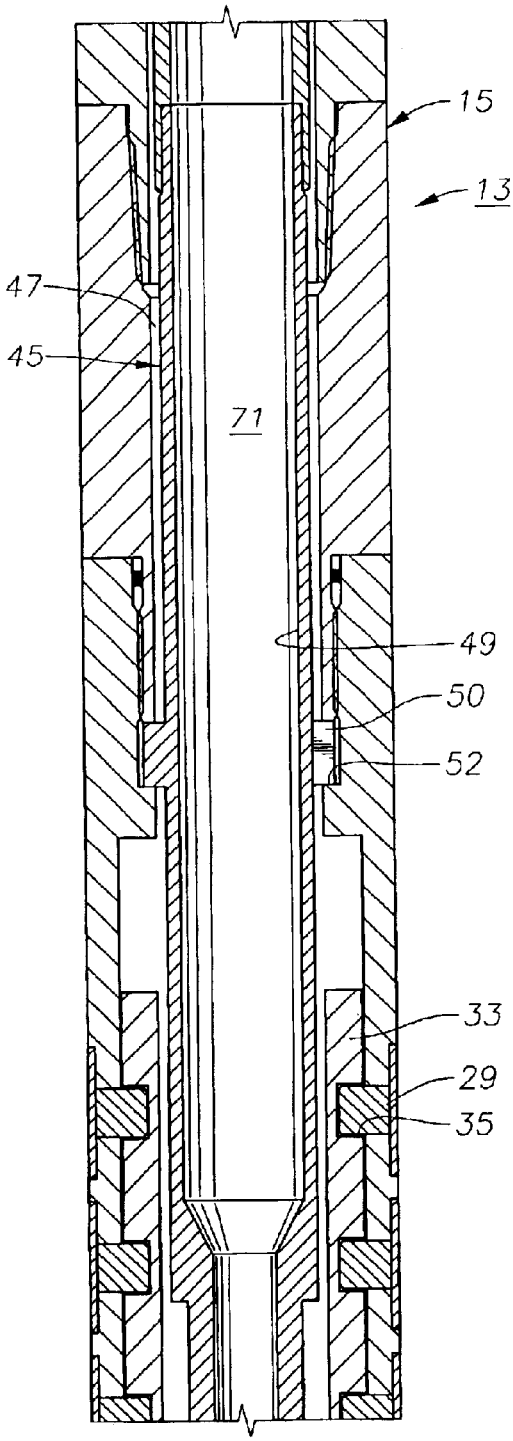
FIGS. 2A and 2B comprise a vertical sectional view of the valve assembly of FIGS. 1A and 1B, but shown in a closed position.
Figure 2B:
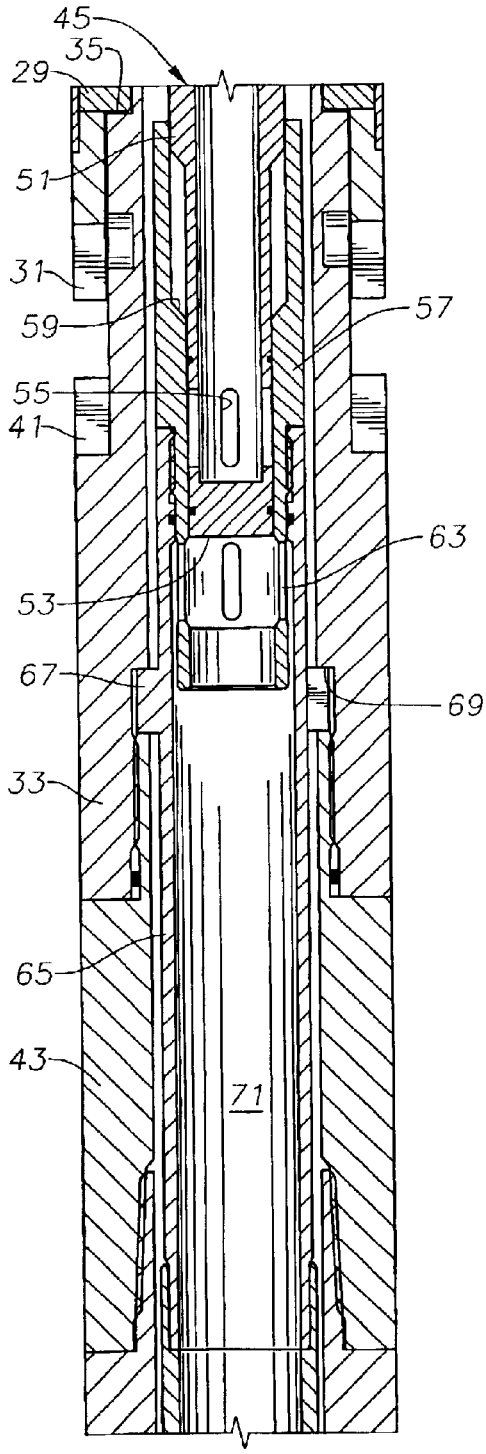

Referring again to FIG. 1B, a lower adapter 43 secures by threads to the lower end of lower sub 33. Lower adapter 43 has the same configuration as upper adapter 15 for connecting to another portion of drill string 19. Preferably lower adapter 43 connects into drill string 19 at a fairly close distance to a drill motor and bit assembly (not shown). Outer member 13 thus is made up of upper adapter 15, upper sub 27, lower sub 33 and lower adapter 43. The upper portion of outer member 13, which is made up of upper sub 27 and upper adapter 15, will telescope upward relative to the lower portion, which is made up of lower sub 33 and lower adapter 43. FIGS. 1A and 1B show the retracted position, while FIGS. 2A and 2B show the extended position.

An inner member 45 extends through outer member 13. Inner member 45 has a number of components, and its outer diameters are all less than the inner diameters of adjacent portions of outer member 13, resulting in an annular passage 47 between inner member 45 and outer member 13. Inner member 45 has a tubular upper portion 49 that joins inner conduit 21 of drill string 19. Inner upper portion 49 has outward extending lugs 50 that are received within a recess of upper sub 27. The recess is defined by an upward facing shoulder 52 of upper sub 27 and the lower end of upper adapter 15. Lugs 50 are spaced apart circumferentially from each other so as to not impede fluid flow through annulus 47. Lugs 50 and shoulder 52 prevent any axial movement of inner upper portion 49 relative to upper sub 27.

Inner upper portion 49 has a valve member 51 formed on its lower end. Valve member 51 comprises a tube that has a closed lower end 53. A plurality of ports 55 are located in the sidewall of valve member 51 directly above closed end 53. Valve member 51 lands within a valve sleeve 57, which has an upward facing conical shoulder 59 that provides a lower limit for the downward travel of valve member 51. Valve sleeve 57 sealingly receives closed end 53. A plurality of bypass ports 63 are located in valve sleeve 57, with each port 63 registering with one of the ports 55 when in the open position of FIGS. 1A and 1B.

An inner member lower tube 65 is secured to valve sleeve 57. The inner diameter of lower tube 65 is greater than the outer diameter of valve sleeve 57 at ports 63 by a selected amount to create an annular clearance 66. While in the position shown in FIG. 1B, fluid may flow upward, as indicated by the arrows, through clearance 66, ports 63, 55, and into the interior of valve member 51. Ports 63 and clearance 66 serve as a bypass to allow flow around closed end 53 of valve member 51 while in the open position.

Lower tube 65 is axially retained with a lower portion of outer member 13, which comprises lower sub 33 and lower adapter 43. This is handled by a plurality of lugs 67 on the exterior of lower tube 65. Lugs 67 locate within a recess that is formed by a downward facing shoulder 69 of lower sub 33 and the upper end of lower adapter 43. Lugs 67 are spaced apart circumferentially to allow fluid flow through annular passage 47.

An inner passage 71 extends through the various components of inner member 45. Inner member 45, like outer member 13, has an upper portion that moves axially relative to a lower portion. The upper portion is made up of inner upper portion 49 and valve member 51. The lower portion of inner member 45 is made up of valve sleeve 57 and lower tube 65.

In operation, valve assembly 11 is connected into drill string 19 at a point near the lower end of the drill string. Typically, the operator would place valve assembly 11 in a closed position prior to running drill string 19 into the well. This may be done at the drill rig floor by restraining lower adapter 43 against rotation while rotating outer adapter 13 about one-fourth turn in a counterclockwise direction looking downward. This causes pins 29 (FIG. 1B) to move from transverse portions 37 to axial portion 39 (FIG. 3). Either before or after the incremental rotation, the operator suspends valve assembly 11 vertically. This causes upper sub 27 and its pins 29 to move upward relative to lower sub 33 and its slot 35 (FIG. 3). When the upper pins 29 reach the upper ends of axial slots 39, the operator rotates upper adapter 15 one-fourth turn back clockwise relative to lower adapter 43. Pins 39 are now in the upper three transverse slot portions 37 (FIG. 3). Pins 39 and transverse slot portions 37 of slot 35 thus serve as a retainer to maintains valve assembly 11 in the extended position.

As upper sub 27 moves upward relative to lower sub 33, valve member 51 also moves upward relative to valve sleeve 57. Closed lower end 53 moves upward to the position of FIG. 2B above ports 63 in valve sleeve 57. Any upward flow through inner passage 71 will be blocked by closed end 53.

When the drill bit reaches the bottom of the well, the operator will open valve assembly 11 by rotating drill string 19 one-fourth turn counterclockwise. Because of the weight of drill string 19 on valve assembly 11, the lower portion of outer member 13, including lower sub 33, does not rotate, thus causing each set of pins 39 to now enter axial portion 39 of slot 35 (FIG. 3). The operator allows the weight of the drill string above valve assembly 11 to move the upper portion of outer member 13 downward relative to the lower portion of outer member 13 until lugs 31 contact the shoulders between lugs 41. Outer member 13 will then be in compression. At this point, pins 29 (FIG. 1B) will be in alignment with the three lower transverse portions 37 (FIG. 3). The operator rotates drill string 19 one-fourth turn clockwise, causing upper sub 27 to rotate relative to lower sub 33, placing pins 29 at the ends of the transverse portions 37. At the same time the upper portion of outer member 13 moved downward, valve member 51 also moved downward in valve sleeve 57 to the position shown in FIG. 1B. Ports 63 and 55 will now align with each other, placing valve assembly 11 in an open position.

The operator pumps a fluid down annular passage 23, the fluid typically being a gas such as air. The fluid flows down annular passage 47 and is used to drive the drill motor to rotate the drill bit (not shown) while drill string 19 remains stationary. Cuttings and return air flow up inner passage 71, through clearance 66 and ports 63 and 55 into the interior of valve member 51. The fluid continues to flow up inner passage 71 into inner passage 25 of drill string 19. When the operator wishes to close valve assembly 11, he simply reverses the steps mentioned above. Normally, when tripping the drill string 19 out of the well such as to change the drill bit, the operator will close the valve assembly.

The invention has significant advantages. The valve assembly provides a safety shutoff to prevent the flow of gas or other formation fluids up through the drill string, particularly while running the drill string into the well or retrieving the drill string from the well. The valve assembly is particularly useful when drilling into deep coal beds that contain methane gas. The use of air as a drilling medium avoids having to utilize liquid drilling fluids, which tend to encroach into and damage such formations. The valve is easily moved between open and closed positions by manipulating the drill string. The valve can be retained in either the open or closed position.

While the invention has been shown in only one of its forms, it should be apparent to those skilled in the art that it is not so limited but is susceptible to various changes without departing from the scope of the invention. For example, although the drill string shown has dual passages within it, the valve assembly could also operate with a single passage drill string, with the exterior of the valve assembly serving as an annulus passage for return flow. Also, while the valve shows a valve member that moves with the upper portion of the valve while the valve sleeve remains stationary with the lower portion of the valve assembly, these could be reversed. Furthermore, the pins could protrude outward from an inner member and the slot located on an inner diameter of an outer member.

What is claimed is:

1. An apparatus for drilling a well, comprising:

a drill string having an inner passage;

a tublar outer member connected into the drill string and having an axial bore, the tublar outer member having upper and lower portions that telescopingly engage one another and are axially movable relative to each other between a retracted position and an extended position;

a tubular inner member located in the bore of the outer member, the inner member having an axial passage that communicates with the inner passage of the drill string, the inner member having an outer diameter smaller than a diameter of the bore; and a valve in the axial passage of the inner member that is actuated by selected movement of the upper and lower portions of the tubular outer member in the drill string between the retracted and extended positions for opening and closing the axial passage.

2. The apparatus according to claim 1, wherein moving the upper portion of the outer member in a direction away from the lower portion of the outer member causes the valve to move to the closed position.

3. The apparatus according to claim 1, wherein rotating the upper portion of the outer member relative to the lower portion of the outer member a selected increment and moving the upper portion of the outer member in a direction away from the lower portion of the outer member causes the valve to move to the open position.

4. The apparatus according to claim 1, wherein:

the upper and lower portions of the outer member engage each with a pin and slot arrangement, the slot having circumferently extending portion and an axially extending portion, so that rotating the upper portion of the outer member relative to the lower portion a selected increment moves the pin from the circumferentially extending portion to the axially extending portion to enable axial movement of the upper and lower portions of the outer member relative to each other.

5. The apparatus according to claim 1, and wherein the apparatus further comprises:

a plurality of downward facing lugs on the upper portion of the outer members;

a plurality of upward facing lugs on the lower portion of the outer member; and wherein the downward facing lugs intermesh with the upward facings lugs while the upper and lower portions of the outer member are in the retracted position, and the downward facing lugs disengage from the upward facing lugs while the upper and lower portions of the outer member are in the extended position.

6. An apparatus for drilling a well, comprising:

a drill string having an inner and an annular passage;

a tubular outer member connected into the drill string and having an axial bore;

a tubular inner member located in the outer member, the inner member having an axial passage that communicates with the inner passage of the drill string, the inner member having an outer diameter smaller than a diameter of the bore, defining and annular passage that communicates with the annular passage of the drill string;

a valve in the axial passage of the inner member that is actuated by selective movement of the drill string for opening and closing the axial passage; and a retainer mechanism cooperating with the valve for selectively retaining the valve in an open position and selectively retaining the valve in closed position.

7. The apparatus according to claim 6, wherein the valve is moved to a closed position by lifting the drill string from a drilling position.

8. The apparatus according to claim 6, wherein the valve is moved from an open position to a closed position by rotating the drill string a selected increment and lifting the drill string.

9. The apparatus according to claim 6, wherein:

the outer member has an upper portion and a lower portion that are axially movable relative to each other a selected distance by selectively placing the drill string in compression and in tension;

the inner member has an upper portion that is axially movable in unison with the outer member and a lower portion that is stationary relative to the lower portion of the outer member;

the valve has a first portion that moves in unison with the upper portions of the inner and outer members and a second portion that is stationary relative to the lower portions of the inner and outer members, the movement of the first portion of the valve relative to the second portion of the valve causing the valve to move between open and closed positions.

10. An apparatus for drilling a well, comprising:

a drill string having an inner and an annular passage;

a tubular outer member connected into the drill string and having an axial bore;

a tubular inner member located in the bore of the outer member, the inner member having an axial passage that communicates with the inner passage of the drill string, the inner member having an outer diameter smaller than a diameter of the bore, defining an annular passage that communicates with the annular passage of the drill string;

a valve in the axial passage of the inner member that is actuated by selective movement of the drill string for opening and closing the axial passage; and a torque transfer mechanism in the outer member for transferring any torque from portions of the drill string above to portions of the drill string below.

11. In a well drilling apparatus having a drill string with an inner passage and an annular passage, a valve assembly comprising:

a tubular outer member adapted to be connected into the drill string and having an axial bore;

a tubular inner member located in the bore of the outer member, the inner member having an axial passage for communicating with the inner passage of the drill string, the inner member having an outer diameter smaller than a diameter of the bore, defining an annular passage for communicating with the annular passage of the drill string;

the outer member having an upper portion and a lower portion that are movable relative to each other; and a valve having first and second cooperative members that are movable relative to each other, the first cooperative member being in engagement with the upper portion of the outer member, the second cooperative member being in engagement with the lower portion of the outer member, so that moving the upper portion of the outer member relative to the lower portion of the outer member causes the first cooperative member to move relative to the second cooperative member, thereby moving the valve between an open position and a closed position.

12. The apparatus according to claim 11, wherein moving the upper portion of the outer member in a direction away from the lower portion of the outer member causes the valve to move to the closed position.

13. The apparatus according to claim 11, wherein rotating the upper portion of the outer member relative to the lower portion of the outer member a selected increment and moving the upper portion of the outer member in a direction away from the lower portion of the outer member causes the valve to move to the open position.

14. The apparatus according to claim 11, wherein:

the second cooperative member comprises a valve sleeve having a port; and the first cooperative member comprises a tube with a closed end that inserts inside the sleeve and blocks the port while the valve is in the closed position.

15. The apparatus according to claim 11, wherein:

the upper and lower portions of the outer member engage each other with a pin and slot arrangement, the slot having a circumferentially extending portion and an axially extending portion, so that rotating the upper portion of the outer member relative to the lower portion a selected increment moves the pin from the circumferentially extending portion to the axially extending portion to enable axial movement of the upper and lower portions of the outer member relative to each other.

16. The apparatus according to claim 11, wherein the upper and lower portions of the outer member telescope between a retracted and an extended position, and wherein the apparatus further comprises:

a plurality of downward facing lugs on the upper portion of the outer member;

a plurality of upward facing lugs on the lower portion of the outer member; and wherein the downward facing lugs intermesh with the upward facing lugs while the upper and lower portions of the outer member are in the retracted position, and the downward facing lugs disengage from the upward facing lugs while the upper and lower portions of the outer member are in the extended position.

17. A method for drilling a well, comprising:

(a) inserting a tubular inner member into a bore of a tubular outer member, the inner member having an inner passage and an outer diameter smaller than a diameter of the bore, defining an annular passage;

(b) mounting a valve in the inner passage of the inner member;

(c) connecting the outer member into a drill string having an inner passage, an annular passage, and a drill bit, and lowering the drill string to a bottom of the well;

(d) pumping a fluid down the annular passage of the drill string and the annular passage around the inner member, and rotating the bit;

(e) returning fluid and cutting up the inner passages of the drill string and inner member and through the valve; then, when it is desired to stop drilling;

(f) ceasing step (d) and moving the drill string in a selected manner to cause the valve to move to a closed position, thereby blocking any upward flow of well fluid through the inner passages; and (g) retaining the valve in the closed position and retrieving the drill string with the valve is in the closed position.

18. The method according to claim 17, wherein step (f) comprises lifting the drill string.

19. The method according to claim 17, wherein step (f) comprises lifting and rotating the drill string a selected increment.

20. The method according to claim 17, wherein:

step (c) comprises placing the valve in the closed position and retaining the valve in the closed position while lowering the drill string into the well; and step (d) further comprises manipulating the drill string in a selected manner to cause the valve to move to an open position.

* * * * *

UNITED STATES PATENT AND TRADEMARK OFFICE

CERTIFICATE OF CORRECTION

PATENT NO. : 6,918,452 B2
DATED : July 19, 2005
INVENTOR(S) : Kwong-Onn C. Chan et al.

It is certified that error appears in the above-identified patent and that said Letters Patent is hereby corrected as shown below:

Column 1,
Line 43, delete “a” before “hammer”.

Column 8,
Line 43, delete “cutting” and insert -- cuttings --.

Signed and Sealed this

Eleventh Day of October, 2005

JON W. DUDAS
*Director of the United States Patent and Trademark Office*